US005503644A

United States Patent [19]

Graiff et al.

[11] Patent Number: 5,503,644

[45] Date of Patent: Apr. 2, 1996

[54] GASOLINE COMPOSITION FOR REDUCING INTAKE VALVE DEPOSITS IN PORT FUEL INJECTED ENGINES

[75] Inventors: Leonard B. Graiff, Houston; Robert P. Aiello, Cypress; H. Dale Millay; Michael J. Riley, both of Houston; Kevin W. Poindexter, Katy, all of Tex.

[73] Assignee: Shell Oil Company, Houston, Tex.

[21] Appl. No.: 233,288

[22] Filed: Apr. 26, 1994

Related U.S. Application Data

[63] Continuation of Ser. No. 108,785, Aug. 18, 1993, abandoned, which is a continuation of Ser. No. 842,858, Feb. 26, 1992, abandoned, which is a continuation-in-part of Ser. No. 764,272, Sep. 23, 1991, abandoned, and a continuation-in-part of Ser. No. 897,132, Jun. 11, 1992, abandoned, which is a continuation of Ser. No. 842,858, Feb. 26, 1992, abandoned, which is a continuation-in-part of Ser. No. 764,272, Sep. 23, 1991, abandoned.

[51] Int. Cl.[6] ..... C10L 1/22

[52] U.S. Cl. ..... 44/387; 44/415; 44/432

[58] Field of Search ..... 44/415, 432, 425, 44/387

[56] References Cited

U.S. PATENT DOCUMENTS

| | | |
|---|---|---|
| 4,038,044 | 7/1977 | Garth . |
| 4,121,911 | 10/1978 | Garth . |
| 4,160,648 | 7/1979 | Lewis et al. . |
| 4,191,537 | 3/1980 | Lewis et al. . |
| 4,197,409 | 4/1980 | Lilburn . |
| 4,231,759 | 11/1980 | Udelhofen et al. . |
| 4,357,148 | 11/1982 | Graiff . |
| 4,936,868 | 6/1990 | Johnson . |
| 5,006,130 | 4/1991 | Aiello et al. . |

FOREIGN PATENT DOCUMENTS

| | | |
|---|---|---|
| 2010324 | 6/1979 | United Kingdom . |
| WO91/12303 | 8/1991 | WIPO . |

*Primary Examiner*—Margaret Medley

[57] ABSTRACT

Intake valve deposits in port fuel injected engines are reduced by using a fuel containing a mixture of (a) an oil soluble polyamine selected from (i) an aliphatic alkylene polyamine containing at least one olefinic polymer chain attached to a nitrogen and/or carbon atom of the alkylene radical(s) connecting the amino nitrogen atoms and said polyamine having a number average molecular weight in the range of from about 600 to about 10,000, (ii) a Mannich polyamine comprising the condensation product of a high molecular weight sulfur-free alkyl-substituted hydroxyaromatic compound wherein the alkyl group has a number average molecular weight from about 600 to about 10,000, an amine which contains an amino group having at least one active hydrogen atom, and an aldehyde, wherein the respective molar ratio of reactants is 1:0.1–10:0.1–10, or (iii) mixtures of (i) and (ii) and (b) an oil soluble hydrocarbyl poly(oxyalkylene)aminocarbamate having a number average molecular weight in the range of from about 600 to about 10,000 having at least one basic nitrogen atom wherein the hydrocarbyl group contains from 1 to about 30 carbons atoms, and wherein the mixture is present in an amount of 5–1000 ppmw basis the fuel and the weight ratio of component (a) to component (b) ranges from about 3:1 to about 1:2. The fuels are also compatible with carburetor and throttle body injected engines.

46 Claims, 1 Drawing Sheet

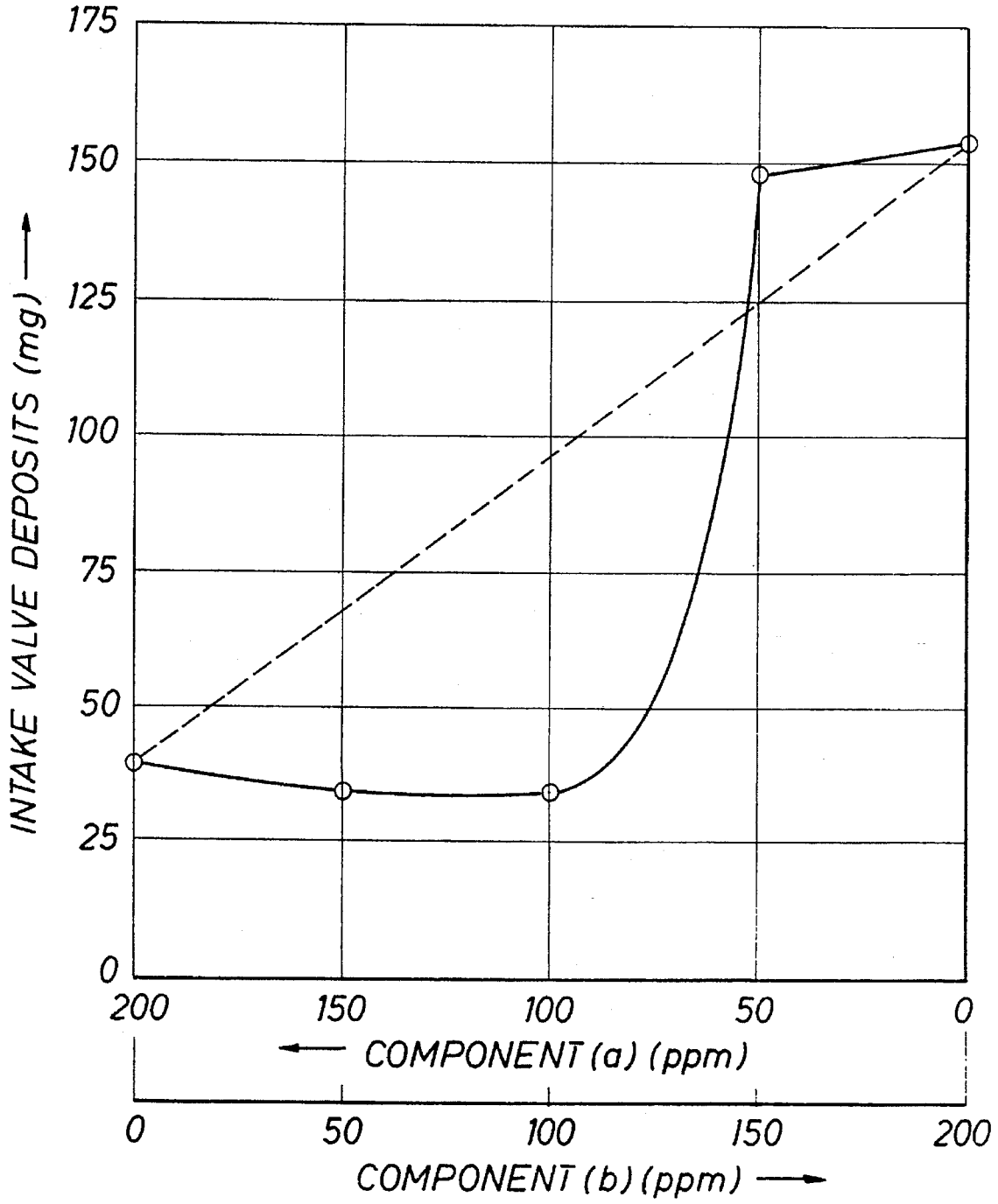
175
150
125
100
75
50
25
0
INTAKE VALVE DEPOSITS (mg)
200
150
100
50
0
COMPONENT (a) (ppm)
0
50
100
150
200
COMPONENT (b) (ppm)

GASOLINE COMPOSITION FOR REDUCING INTAKE VALVE DEPOSITS IN PORT FUEL INJECTED ENGINES

This is a continuation of application Ser. No. 08/108,785, filed Aug. 18, 1993, now abandoned, which is a continuation of application Ser. No. 07/842,858, filed Feb. 26, 1992, now abandoned, which is a continuation-in-part of application Ser. No. 07/764,272, filed Sep. 23, 1991, now abandoned, and application Ser. No. 07/897,132 filed Jun. 11, 1992, now abandoned, which is a continuation of application Ser. No. 07/842,858 filed Feb. 26, 1992, now abandoned, which is a continuation-in-part of application Ser. No. 07/764,272 filed Sep. 23, 1991, now abandoned.

BACKGROUND OF THE INVENTION

1. Field of the Invention

The present invention relates to gasoline compositions for reducing intake valve deposits in port fuel injected engines.

2. Background

Gasoline compositions have traditionally been formulated to improve the performance of carburetor and throttle body injected engines. Beginning in about 1984, electronic port fuel injected engines were commonly introduced by automobile manufacturers. Shortly thereafter, in about 1985, problems began to be reported with intake valve deposits in electronic port fuel injected engines characterized by hard starting, stalls, and stumbles during acceleration and rough engine idle.

Accordingly, it would be desirable to have fuel compositions which reduced or eliminated such undesirable intake valve deposits in electronic port fuel injected engines. Also, since some carburetor and throttle body injector engines will still be in use for the foreseeable future, it would be desirable if such fuels could also be compatible with these engines. Intake valve detergency is generally defined by the BMW NA standard of intake valve cleanliness for unlimited mileage, which is an established correlation of good driveability with average intake valve deposit weight of 100 milligrams/valve or less.

Oil-soluble polyalkylene polyamines containing an olefinic polymer chain are known to improve detergent properties of fuels used in carburetor and throttle body type engines. These polyalkylene polyamines, particularly when used at high concentrations, can result in valve sticking and an increase in octane requirement. Various materials have been added to these polyalkylene polyamines to improve their performance. U.S. Pat. No. 5,006,130, issued April 9, 1991, discloses as a gasoline additive (a) polyalkylene polyamine and (b) at least one component selected from (i) a polymer of a $C_2$ to $C_6$ monoolefin, (ii) a copolymer of a $C_2$ to $C_6$ monoolefin, (iii) the corresponding hydrogenated polymer of copolymer, (iv) an oil soluble poly(oxyalkylene) alcohol, glycol or polyol or a mono or di ether thereof.

Hydrocarbylpoly(oxyalkylene)aminocarbamates have been disclosed in U.S. Pat. No. 4,197,409, issued Apr. 8, 1980 and U.S. Pat. No. 4,191,537, issued Mar. 4, 1980, as useful as deposit control additives which effectively control deposits in intake systems (carburetor, valves, etc.) of engines operated with fuels containing them, but which do not contribute to the combustion chamber deposits which cause increased octane requirements.

Mannich polyamines comprising the condensation product of a high molecular weight alkyl-substituted hydroxy aromatic compound, an amine which contains an amino group having at least one active hydrogen atom, and an aldehyde have been disclosed in U.S. Pat. No. 4,231,759, issued Nov. 4, 1980, as useful for importing detergency properties to an automotive fuel in order to keep intake valves clean.

OBJECTS OF THE INVENTION

It is an object of this invention to provide a gasoline additive combination which makes use of the good detergency properties of polyamines but which minimizes valve sticking and octane requirement increase which can result from the use of large amounts of polyamines.

It is further an object of this invention to provide a gasoline composition which reduces intake valve deposits in electronic port fuel injected engines and the poor driveability which is characteristic of intake valve deposition in these engines and which is also compatible with carburetor and throttle body injected engines which are still in use.

SUMMARY OF THE INVENTION

The present invention is directed to an unleaded gasoline composition comprising a major amount of a hydrocarbon base fuel of the gasoline boiling range containing an effective amount to reduce intake valve deposits in electronic port fuel injected engines of from about 5 ppmw to about 1000 ppmw based on the fuel composition of a mixture of (a) an oil soluble polyamine selected from the group consisting of (i) an aliphatic alkylene polyamine containing at least one olefinic polymer chain attached to a nitrogen and/or carbon atom of the alkylene radical(s) connecting the amino nitrogen atoms and said polyamine having a number average molecular weight in the range of from about 600 to about 10,000, (ii) a Mannich polyamine comprising the condensation product of a high molecular weight sulfur-free alkyl-substituted hydroxyaromatic compound wherein the alkyl group has a number average molecular weight from about 600 to about 3000, an amine which contains an amino group having at least one active hydrogen atom, and an aldehyde, wherein the respective molar ratio of reactants is 1:0.1–10:0.1–10, or (iii) mixtures of (i) and (ii) and (b) an oil soluble hydrocarbyl poly(oxyalkylene) aminocarbamate having a number average molecular weight in the range of from about 600 to about 10,000 having at least one basic nitrogen atom wherein said hydrocarbyl group contains from 1 to about 30 carbons atoms, and wherein the weight ratio of said polyamine to said hydrocarbyl poly(oxyalkylene) aminocarbamate ranges from about 3:1 to about 1:2.

BRIEF DESCRIPTION OF THE DRAWING

The sole drawing shows the synergistic improvement in intake valve deposit control obtained by using combinations of aliphatic alkylene polyamine and a hydrocarbyl poly(oxyalkylene) aminocarbamate.

DESCRIPTION OF THE PREFERRED EMBODIMENTS

Component (a)

Component (a) may be selected from either an aliphatic alkylene polyamine, a Mannich polyamine or mixtures of an aliphatic alkylene polyamine and a Mannich polyamine.

(i) Aliphatic Alkylene Polyamine

The oil soluble aliphatic alkylene polyamine component detergent (a) (i) has at least one polyester chain having an about 500 to about 9,900 $\overline{Mn}$ (number average molecular weight) and preferably from about 550 to about 4,900 $\overline{Mn}$, and particularly from about 600 to about 1,300 $\overline{Mn}$, and which may be saturated or unsaturated and straight or branched chain and attached to a nitrogen and/or carbon atom of the alkylene radicals connecting the amino-nitrogen atoms.

Preferred polyolefin-substituted polyalkylene polyamines have the structural formula I

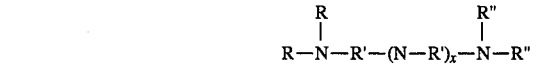

(I)

where R is selected from the group consisting of a hydrogen atom and a polyolefin having a $\overline{Mn}$ from about 500 to about 9,900, at least one R being a polyolefin group, R' is an alkylene radical having from 1 to 8 carbon atoms, preferably 1 to 4 carbon atoms, R" is hydrogen or lower alkyl, and x is 0–5. Preferred is when one R is a branched-chain olefin polymer and the other R is hydrogen. The number average molecular weight range of R is preferably 550 to 4,900 $\overline{Mn}$, with a range of 600–1300 $\overline{Mn}$ being particularly preferred.

The olefinic polymers (R) which are reacted with polyamines to form the additive of the present invention include olefinic polymers derived from alkanes or alkenes with straight or branched chains, which may or may not have aromatic or cycloaliphatic substituents, for instance, groups derived from polymers or copolymers of olefins which may or may not have a double bond. Examples of non-substituted alkenyl and alkyl groups are polyethylene groups, polypropylene groups, polybutylene groups, polyisobutylene groups, polyethylene-polypropylene groups, polyethylene-poly-alpha-methyl styrene groups and the corresponding groups without double bonds. Particularly preferred are polypropylene and especially polyisobutylene groups.

The R" group may be hydrogen but is preferably lower alkyl, i.e., containing up to 7 carbon atoms, and more preferably is selected from methyl, ethyl, propyl and butyl groups.

The polyamines used to form the aliphatic polyamine compounds of this invention include primary and secondary low molecular weight aliphatic polyamines such as ethylene diamine, diethylene triamine, triethylene tetramine, propylene diamine, butylene diamine, trimethyl trimethylene diamine, tetramethylene diamine, diaminopentane or pentamethylene diamine, hexamethylene diamine, heptamethylene diamine, diaminooctane, decamethylene diamine, and higher homologues up to about 18 carbon atoms in the preparation of these compounds the same amines can be used or substituted amines can be used such as N-methyl ethylene diamine, N-propyl ethylene diamine, N,N-dimethyl 1,3-propane diamine, N-2-hydroxypropyl ethylene diamine, penta-(1-methylpropylene)hexamine, tetrabutylene-pentamine, hexa-(1,1-dimethylethylene)heptane, di-(1-methylamylene)-triamine, tetra-(1,3-dimethylpropylene)pentamine, penta-(1,5-dimethylamylene)-hexamine, di(1-methyl-4-ethylbutylene)triamine, penta-(1,2-dimethyl-1-isopropyl ethylene)hexamine, tetraoctylenepentamine and the like.

Compounds possessing triamine as well as tetramine and pentamine groups are applicable for use because these can be prepared from technical mixtures of polyethylene polyamines, which could offer economic advantages.

The polyamine can be a cyclic polyamine, for instance, the cyclic polyamines formed when aliphatic polyamines with nitrogen atoms separated by ethylene groups were heated in the presence of hydrogen chloride.

An example of a suitable process for the preparation of the compounds employed according to the invention is the reaction of a halogenated polyhydrocarbon having at least one halogen atom as a substituent and a hydrocarbon chain as defined hereinbefore for R with a polyamine. The halogen atoms are replaced by a polyamine group, while hydrogen halide is formed. The hydrogen halide can then be removed in any suitable way, for instance, as a salt with excess polyamine. The reaction between halogenated hydrocarbon and polyamine is preferably effected at elevated temperature in the presence of a solvent; particularly a solvent having a boiling point of at least about 160° C.

The reaction between polyhydrocarbon halide and a polyamine having more than one nitrogen atom available for this reaction is preferably effected in such a way that cross-linking is reduced to a minimum, for instance, by applying an excess of polyamine.

The amine additive according to the invention can be prepared, for example, by alkylation of low molecular weight aliphatic polyamines. For instance, a polyamine is reacted with an alkyl or alkenyl halide. The formation of the alkylated polyamine is accompanied by the formation of hydrogen halide, which is removed, for example, as a salt of starting polyamine present in excess. With this reaction between alkyl or alkenyl halide and the strongly basic polyamines, dehalogenation of the alkyl or alkenyl halide can occur as a side reaction, so that hydrocarbons are formed as by-products. Their removal can, without objection, be omitted.

The number average molecular weight of the aliphatic alkylene polyamine will range from about 600 to about 10,000 $\overline{Mn}$, preferably from about 600 to about 5000 $\overline{Mn}$, and most preferably from about 600 to about 1500 $\overline{Mn}$.

(ii) Mannich Polyamine

The oil soluble Mannich polyamine component detergent (a) (ii) comprises a condensation product of a high molecular weight alkyl-substituted hydroxyaromatic compound, an amine which contains an amino group having at least one active hydrogen atom (preferably a polyamine), and an aldehyde. Such condensation products can be prepared by condensing in the usual manner under Mannich reaction conditions:

(1) an alkyl-substituted hydroxyaromatic compound, whose a alkyl-substituent has a 600–10,000 $\overline{Mn}$, preferably a polyalkylphenol whose polyalkyl substituent is derived from 1-mono-olefin polymers having a $\overline{Mn}$ of about 600–3,000, more preferably about 750–1200, and most preferably 1000–1100;

(2) an amine (preferably a polyamine) containing at least one>NH group, preferably an alkylene polyamine of the formula

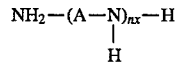

wherein A is a divalent alkylene radical having 2 to 6 carbon atoms and x is an integer from 1 to 10; and (3) an aldehyde, preferably formaldehyde.

The Mannich polyamine utilized is described in detail in U.S. Pat. No. 4,231,759, issued Nov. 4, 1980, which is incorporated by reference herein. The foregoing high molecular weight products employed in the fuels of this invention are preferably prepared according to the conventional methods heretofore employed for the preparation of Mannich condensation products, using the above-named reactance in the respective molar ratios of high molecular weight alkyl-substituted hydroxyaromatic compound, amine and aldehyde of approximately 1:0.1–10:0.1–10. A suitable condensation procedure involves adding at a temperature of from room temperature to about 93° C. the formaldehyde reagent (e.g. Formalin) to a mixture of reagents (1) and (2) above alone or in an easily removed organic solvent, such as benzene, xylene or toluene or in solvent-refined neutral oil and then heating the reaction mixture to an elevated temperature (120°–175° C.) while preferably blowing with an inert stripping gas, such as nitrogen, carbon dioxide, etc. until dehydration is complete. The product so obtained is finished by filtration and dilution as desired.

The preferred detergent additives employed in this invention are high molecular weight Mannich condensation products, formed by reacting (1) an alkylphenol, whose alkyl group has 600–3,000 $\overline{Mn}$; (2) an ethylene polyamine, an amine reactant; and (3) a formaldehyde affording reactant in the respective molar ratio of 1.0:0.5–2.0:1.0–3.0.

Representative of the high molecular weight alkyl-substituted hydroxyaromatic compounds are polypropylphenol, polybutylphenol and other polyalkylphenols. These polyalkylphenols may be obtained by the alkylation, in the presence of an alkylating catalyst; such as $BF_3$, of phenol with high molecular weight polypropylene, polybutylene and other polyalkylene compounds to give alkyl substituents on the benzene ring of phenol having an average 600–100, 000 $\overline{Mn}$.

The 600 $\overline{Mn}$ and higher $\overline{Mn}$ alkyl-substituents on the hydroxyaromatic compounds may be derived from high molecular weight polypropylenes, polybutenes and other polymers of mono-olefins, principally 1-monoolefins. Also useful are copolymers of mono-olefins with monomers copolymerizable therewith wherein the copolymer molecular contains at least 90%, by weight, of mono-olefin units. Specific examples are copolymers of butenes (butene-1, butene-2 and isobutylene) with monomers copolymerizable therewith wherein the copolymer contains at least 90% by weight, of propylene and butene units, respectively. Said monomers copolymerizable with propylene or said butenes include monomers containing a small proportion of unreactive polar groups such as chloro, bromo, keto, ether, aldehyde, which do appreciably lower the oil-solubility of the polymer. The comonomers polymerized with propylene or said butenes may be aliphatic and can also contain non-aliphatic groups, e.g., styrene, methylstyrene, p-dimethylstyrene, divinyl benzene and the like. From the foregoing limitation placed on the monomer copolymerized with propylene or said butenes, it is abundantly clear that said polymers and copolymers of propylene and said butenes are substantially aliphatic hydrocarbon polymers. Thus the resulting alkylated phenols contain substantially alkyl hydrocarbon substituents having $\overline{Mn}$ upward from 600.

In addition to these high molecular weight hydroxyaromatic compounds others which may be used include, exclusive of sulfurized derivatives, high molecular weight alkyl-substituted derivatives of resorcinol, hydroquinone, cresol, catechol, xylenol, hydroxy diphenyl, benzylphenol, phenethylphenol, naphthol, tolynaphthol, among others. Preferred for the preparation of such preferred Mannich condensation products are the polyalkylphenol reactants, e.g., polypropylphenol and polybutylphenol whose alkyl group has a 600–3,000 $\overline{Mn}$, the more preferred alkyl groups having a 740–1,200 $\overline{Mn}$, while the most preferred alkyl groups is a polypropyl group having a 800–850 $\overline{Mn}$, desirably about 825 $\overline{Mn}$.

The preferred configuration of the alkyl-substituted hydroxyaromatic compound is that of a para-substituted mono-alkylphenol. However, any alkylphenol readily reactive in the Mannich condensation reaction may be employed. Accordingly, ortho mono-alkylphenols and dialkylphenols are suitable for use in this invention.

Various amine reactants may be utilized including mono and polyamines. The preferred amine reactants are alkylene polyamines, principally polyethylene polyamines. Other representative organic compounds containing at least one HN<group suitable for use in the preparation of Mannich condensation products are well known and include the mono and di-amino alkanes and their substituted analogs, e.g., ethylamine, dimethylamine, dimethylaminopropyl amine and diethanol amine; aromatic diamines, e.g., phenylene diamine, diamino naphthalenes; heterocyclic amines, e.g., morpholine, pyrrole, pyrroidine, imidazole, imidazolidine, and piperidine; melamine and their substituted analogs.

Suitable alkylene polyamine reactants include ethylenediamine, diethylene triamine, triethylene tetramine, tetraethylene pentamine, pentaethylene hexamine, hexaethylene heptamine, heptaethylene octamine, octaethylene nonamine, nonaethylene decamine, decaethylene undecamine and mixtures of such amines having nitrogen contents corresponding to the alkyline polyamines, in the formula $H_2N—(A—NH—)_nH$, mentioned before, where A is divalent ethylene and n is an integer from 1 to 10. Corresponding propylene polyamines such as propylene diamine and di-, tri-, tetra-, penta-propylene tri-, tetra-, penta- and hexa-amines are also suitable reactants. The alkylene polyamines are usually obtained by the reaction of ammonia and dihalo alkanes, such as dichloro alkanes. Thus the alkylene polyamines obtained from the reaction of 2 to 11 moles of ammonia with 1 to 10 moles of dichloro alkanes having 2 to 6 carbon atoms and the chlorines on different carbons are suitable alkylene polyamine reactants.

Representative aldehydes for use in the preparation of the high molecular products of this invention include the aliphatic aldehydes such as formaldehyde (including paraformaldehyde and Formalin), acetaldehyde and aldol (b-hydroxybutyraldehyde). We prefer to use formaldehyde or a formaldehydeyielding reactant.

(iii) Mixtures of the Aliphatic Alkylene Polyamine and the Mannich Polyamine

Mixtures of components (a)(i) and (a)(ii) may also be suitably combined with component (b) to prepare the additive composition used in the present invention.

Component (b)—Aminocarbamate

The amine moiety of the hydrocarbyl-terminated poly(oxyalkylene) aminocarbamate is preferably derived from a polyamine having from 2 to about 12 amine nitrogen atoms and from 2 to about 40 carbon atoms. The polyamine is preferably reacted with a hydrocarbyl poly(oxyalkylene) chloroformate to produce the hydrocarbyl poly(oxyalkylene) aminocarbamate fuel additive component (b). The chloroformate is itself derived from hydrocarbyl poly(oxyalkylene) alcohol by reaction with phosgene. The polyamine, encompassing diamines, provides the product poly(oxyalkylene) aminocarbamate with, on the average, at least about one basic nitrogen atom per carbamate molecule, i.e., a nitrogen atom tritratable by strong acid. The polyamine preferably has a carbon-to-nitrogen ratio of from about 1:1 to about 10:1. The polyamine may be substituted with substituents selected from hydrogen, hydrocarbyl groups of from 1 to about 10 carbon atoms, acyl groups of from 2 to about 10 carbon atoms, and monoketone, monohydroxy, mononitro, monocyano, alkyl and alkoxy derivatives of hydrocarbyl groups of from 1 to 10 carbon atoms. It is preferred that at least one of the basic nitrogen atoms of the polyamine is a primary or secondary amino nitrogen. The polyamine component has been described and exemplified more fully in U.S. Pat. No. 4,191,537, issued Mar. 4, 1980, incorporated by reference herein.

Hydrocarbyl, as used in describing all the components of this invention, denotes an organic radical composed of carbon and hydrogen which may be aliphatic, alicyclic, aromatic or combination thereof, e.g., aralkyl. Preferably, the hydrocarbyl group will be relatively free of aliphatic unsaturation, i.e., ethylenic and acetylenic, particularly acetylenic unsaturation. The more preferred polyamine for the aminocarbamate component is a polyalkylene polyamine, including alkylenediamine, and including substituted polyamines, e.g., alkyl and hydroxyalkyl-substituted polyalkylene polyamine. Preferably, the alkylene group contains from 2 to 6 carbon atoms, there being preferably from 2 to 3 carbon atoms between the nitrogen atoms. Examples of such polyamines include ethylenediamine, diethylene triamine, triethylene tetramine, di(trimethylene)triamine, dipropylene triamine, tetraethylene pentamine, etc. Among the polyalkylene polyamines are polyethylene polyamine, polypropylene polyamine containing 2–12 amine nitrogen atoms and 2–24 carbon atoms are especially preferred and in particular, the lower polyalkylene polyamines, e.g., ethylenediamine, dipropylene triamine, etc., are most preferred.

The hydrocarbyl-terminated poly(oxyalkylene) polymers which are utilized in preparing the aminocarbamates are monohydroxy compounds, e.g., alcohols, often termed monohydroxy polyethers, or polyalkylene glycol monocarbyl ethers, or "capped" poly(oxyalkylene) glycols, and are to be distinguished from the poly(oxyalkylene) glycols (diols), or polyols, which are not hydrocarbyl-terminated, i.e., are not capped. The hydrocarbyl-terminated poly(oxyalkylene) alcohols are produced by the addition of lower alkylene oxides, such as ethylene oxide, propylene oxide, butylene oxide, etc. to the hydroxy compound ROH under polymerization conditions, wherein R is the hydrocarbyl group which caps the poly(oxyalkylene) chain. In the poly(oxyalkylene) component of the aminocarbamate, the group R will generally contain from 1 to about 30 carbon atoms, preferably from 2 to about 20 carbon atoms and is preferably aliphatic or aromatic, i.e., an alkyl or alkyl phenyl wherein the alkyl is a straight or branched-chain of from 1 to about 24 carbon atoms. The oxyalkylene units in the poly(oxyalkylene) component preferably contain from 2 to about 5 carbon atoms but one or more units of a larger carbon number may also be present. Each poly(oxyalkylene) polymer contains at least about 5 oxyalkylene units, preferably 8 to about 100 oxyalkylene units, more preferably about 10–100 units and most preferably 10 to about 25 such units. The poly(oxyalkylene) component is more fully described and exemplified in U.S. Pat. Nos. 4,191,537, issued Mar. 4, 1980, and 4,197,409, issued Apr. 8, 1980, incorporated by reference herein. The poly(oxyalkylene) aminocarbamate fuel additive used in compositions of the present invention is obtained by 1 inking the amine component and the poly(oxyalkylene) component together through a carbamate linkage, i.e., $$-O-C(O)-\overset{|}{N}-,$$

wherein the oxygen may be regarded as the terminal hydroxyl oxygen of the poly(oxyalklene) alcohol component, and the carbonyl group, —C(O)—, is preferably provided by a coupling agent, e.g., phosgene. In the preferred method of preparation the hydrocarbyl poly(oxyalklene) alcohol is reacted with phosgene to produce a chloroformate and the chloroformate is reacted with the polyamine. The carbamate linkages are formed as the poly(oxyalklene) chains are bound to the nitrogen of the polyamine to the oxycarbonyl group of the chloroformate. Since there may be more than one nitrogen atom of the polyamine which is capable of reacting with the chloroformate, the aminocarbamate contains at least one hydrocarbyl poly(oxyalkylene) polymer chain bonded through an oxycarbonyl group to a nitrogen atom of the polyamine, but the carbonate may contain from 1 to 2 or more such chains. It is preferred that the hydrocarbyl poly(oxyalkylene) aminocarbamate product contains, on the average, about 1 poly(oxyalkylene) chain per molecule (i.e., is a monocarbamate), although it is understood that this reaction route may lead to mixtures containing appreciable amount of di- or higher poly(oxyalkylene) chain substitution on a polyamine containing several reactive nitrogen atoms. Several especially preferred aminocarbamates are butyl-poly(oxyalkylene)-N-(2-aminoethyl) carbamate and alkylphenyl-poly(oxyalkylene)-N-(2-aminoethyl) carbamate. A particularly preferred carbamate can be expressed by the following formula:

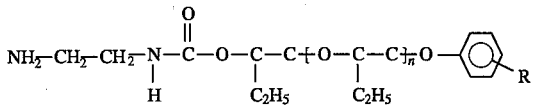

wherein R is hydrogen, alkyl and "n" preferably is greater than about 5. Aminocarbamates suitable for use in the instant invention can be obtained from the Oronite Additives Division of Chevron Chemical Company.

Synthetic methods to avoid higher degrees of substitution, methods of preparation, and other characteristics of the aminocarbamate used as component (b) are more fully described and exemplified in the above-mentioned U.S. Pat. Nos. 4,191,537 and 4,197,409.

The number average molecular weight of the aminocarbamate will range from about 600 to about 10,000 $\overline{Mn}$, preferably from about 600 to about 5000 $\overline{Mn}$ and most preferably from about 600 to about 2000 $\overline{Mn}$.

The total amounts of component (a) and component (b) present in the fuel composition will range from about 5 to about 1000, preferably from about 50 to about 1000, more preferably from about 50 to about 500 and even more preferably from about 100 to about 400 and most preferably from about 200 to about 300 parts per million by weight (ppmw) based on the fuel composition. In particularly preferred embodiments, the total amounts of component (a) and component (b) present in the fuel composition will be about 200 part per million weight (ppmw) or about 250 parts per million weight (ppmw) based on the fuel composition. The weight ratio, component (a): component (b), will range from about 3:1 to about 1:2 and preferably from about 2:1 to about 2:3. In a particularly preferred embodiment the weight ratio is set at about 1:1.

Suitable liquid hydrocarbon fuels of the gasoline boiling range are mixtures of hydrocarbons having a boiling range of from about 25° C. to about 232° C. and comprise mixtures of saturated hydrocarbons, olefinic hydrocarbons and aromatic hydrocarbons. Preferred are gasoline blends having a saturated hydrocarbon content ranging form about 40 to about 80 percent volume, an olefinic hydrocarbon content from about 0 to about 30 percent volume and an aromatic hydrocarbon content ranging from about 10 to about 60 percent volume. The base fuel can be derived from straight run gasoline, polymer gasoline, natural gasoline, dimer or trimerized olefins, synthetically produced aromatic hydrocarbon mixtures from thermally or catalytically reformed hydrocarbons, or from catalytically cracked or thermally cracked petroleum stocks, and the like or mixtures of these.

The hydrocarbon composition and octane level of the base fuel are not critical. The octane level, (R+M)/2, will generally be above 85. Any conventional motor fuel base may be employed in the practice of this invention. For example, in the gasoline, hydrocarbons can be replaced by up to substantial amounts of conventional alcohols, or ethers, conventionally known for use in fuels. The base fuels are desirably substantially free of water, since water could impede a smooth combustion.

Normally, the hydrocarbon fuel mixtures to which the invention is applied are essentially lead-free, but can contain minor amounts of blending agents such as methanol, ethanol, methyl tertiary butyl ether, and the like, e.g., at from about 0.1 to about 15% volume of the base fuel. The fuels can also contain antioxidants such as phenolics, e.g., 2,6-di-tert-butylphenol or phenylenediamines, e.g., N,N'-di-sec-butyl-p-phenylenediamine, dyes, metal deactivators, dehazers such as polyester-type ethoxylated alkylphenol-formaldehyde resins and the like. Corrosion inhibitors, such as a polyhydric alcohol ester of a succinic acid derivative having on at least one of its alpha-carbon atoms an unsubstituted or substituted aliphatic hydrocarbon group having 20 to 500 carbon atoms, for example, pentaerythritol diester of polyisobutylene-substituted succinic acid, the polyisobutylene group having a number average molecular weight of about 950, in an amount of about 1 to 1000 ppmw. The fuels may also contain antiknock compounds such as a methyl cyclopentadienylmanganese tricarbonyl, ortho-azio-phenol and the like as well as co-antiknock compounds such as benzoylacetone.

The additives of the present invention can be added to the fuel neat or in the form of a concentrate. For example, the agent can be added separately to the fuel or blended with the other fuel additives. A concentrate can be prepared comprising a major amount of the additive mixture of the invention and a minor amount of a fuel compatible diluent boiling in the range of about 50° C. to 232° C. The additive can be added to the fuel at any point prior to its delivery to the end user.

The invention also provides a method for operating a port fuel injected engine on an unleaded fuel compatible with carburetor and throttle body injected engines which comprises introducing into an electronic port fuel injected engine with the combustion intake charge an effective amount of a mixture of (a) an oil soluble polyamine selected from the group consisting of (i) an aliphatic alkylene polyamine, (ii) a Mannich amine, or (iii) mixtures of (i) and (ii) and (b) an oil soluble hydrocarbyl poly(oxyalkylene) aminocarbamate in the before-described amounts and ratios.

The ranges and limitations provided in the instant specification and claims are those which are believed to particularly point out and distinctly claim the instant invention. It is, however, understood that other ranges and limitations that perform substantially the same function in substantially the same way to obtain the same or substantially the same result are intended to be within the scope of the instant invention as defined by the instant specification and claims.

The invention will be described by the following examples which are provided for illustrative purposes and are not to be construed as limiting the invention.

Illustrative Embodiment I

This example illustrates the beneficial effect on intake valve deposits of a gasoline additive comprising a mixture of an aliphatic alkylene polyamine and a hydrocarbyl poly(oxyalkylene) aminocarbamate.

Intake valve deposit tests were conducted in a BMW 325 car equipped with the 2.7-liter, six-cylinder engine with port fuel injection, and was operated for 8,050 kilometers on the test fuel. Before the test started, deposits were removed from the cylinder head, intake manifold and piston tops and new intake valves were weighed and installed. The oil and filter were changed, new spark plugs installed and the fuel injectors flow checked. Mileage was accumulated on a road simulation dynamometer. A four minute test cycle was employed. It consisted of a 2 minute acceleration from 54 to 75 km/hr, a 1 minute acceleration to 112 km/hr and a 1 minute deceleration to 54 km/hr. The average speed was about 79 km/hr and the cycle was repeated until 8050 kilometers were accumulated (about 102 hrs).

Table 1 lists the additive compositions used in premium unleaded base gasolines and the average (of six) intake valve deposit weights at the end of the test (8,050 kilometers).

TABLE 1

| Composition | Component (a)(i)[1] ppmw | Component (b)[2] ppmw | Ratio (a)/(b) | BMW 325 Results Avg. Deposit weight, mg |
|---|---|---|---|---|
| 1 | 200 | 0 | 200:0 | 39.0 |
| 2 | 150 | 50 | 3:1 | 34.3 |
| 3 | 100 | 100 | 1:1 | 34.6 |
| 4 | 50 | 150 | 1:3 | 148.6 |
| 5 | 0 | 200 | 0:200 | 153.6 |

[1]Component (a)(i) is H-polyisobutenyl-N',N'-dimethyl-1,3-diaminopropane. $\overline{Mn}$ = 1050.
[2]Component (b) is a hydrocarbyl poly(oxyalkylene) aminocarbamate obtained from the Oronite Additives Division of Chevron Chemical Company as OGA 480. $\overline{Mn}$ = 1400–1800.

Results of these tests are also plotted in the Figure and demonstrate that the gasoline compositions of the invention provide a synergistic improvement in intake valve deposit reduction while concomitantly allowing for the reduction in the amount of aliphatic alkylene polyamine thereby lessening the known effect of the polyamine to cause valve sticking.

Illustrative Embodiment II

Intake valve deposit tests were conducted in a BMW 318i car equipped with the 1.8-liter, four-cylinder engine which was operated for 10,000 miles on the test fuel. Before the test started, deposits were removed from the cylinder head, intake manifold and piston tops and new intake valves were weighed and installed. The oil and filter were changed, new spark plugs installed and the fuel injectors flow checked. Mileage was accumulated on public roads using trained drivers. The test route consisted of about 10% city driving, 20% on secondary roads and 70% highway driving (maximum speed of 65 mph).

The primary test data was the intake valve deposit (IVD) weights at the end of the 10,000-mile test. BMW's pass criteria are as follows: an average deposit weight of 100 milligrams/valve or less at the conclusion of the test meets BMW requirements for unlimited mileage acceptance; an average deposit weight of 250 mg/valve or less at the conclusion of the test meets BMW's requirement for 50,000-mile service.

Table 2 lists the additive compositions used in regular unleaded base gasolines and the average intake valve deposit weights at the end of the test (10,000 miles).

TABLE 2

| Composition | Component (a) ppmw | Component (b) ppmw | Ratio (a)/(b) | BMW 318i Results Avg. Deposit weight, mg |
|---|---|---|---|---|
| 1 | 125[1] | 125[2] | 1:1 | 0 |
| 2 | 125[3] | 125[2] | 1:1 | 44 |

[1]Component (a) is the Amoco Mannich Amine known as "Amoco 596" described in U.S. Pat. No. 4,231,759. $\overline{Mn}$ = 1000–1100.
[2]Component (b) is a hydrocarbyl poly(oxyalkylene) aminocarbamate, $\overline{Mn}$ = 1400-1800, obtained from the Oronite Additives Division of Chevron Chemical Company as OGA 480.
[3]Component (a) is N-polyisobutenyl-N',N'-dimethyl-1,3-diaminopropane. $\overline{Mn}$ = 1050

Comparing the values of intake valve deposits in Table 2 with the similar values in Table 1 (at a ratio of (a)/(b) of 1:1) it can be seen that the aliphatic alkylene polyamines of Table 1 can be replaced with the Mannich polyamine of Table 2 with substantially the same results.

What is claimed is:

1. An unleaded fuel composition comprising a major amount of a hydrocarbon base fuel of the gasoline boiling range containing an effective amount to reduce intake valve deposits in electronic port fuel injected engines of from about 50 ppmw to about 500 ppmw based on the fuel composition of a mixture of (a) an oil soluble polyamine selected from the group consisting of (i) an aliphatic alkylene polyamine containing at least one olefinic polymer chain attached to a nitrogen and/or carbon atom of the alkylene radical(s) connecting the amino nitrogen atoms, said alkylene group having from 1 to 8 carbon atoms, and said polyamine having a number average molecular weight in the range of from about 600 to about 10,000, (ii) a Mannich polyamine comprising the condensation product of a high molecular weight sulfur-free alkyl-substituted hydroxyaromatic compound wherein the alkyl group has a number average molecular weight from about 600 to about 10,000, an amine which contains an amino group having at least one active hydrogen atom, and an aldehyde, wherein the respective molar ratio of reactants is 1:0.1–10:0.1–10, or (iii) mixtures of (i) and (ii) and (b) an oil soluble hydrocarbyl poly(oxyalkylene) aminocarbamate having a number average molecular weight in the range of from about 600 to about 10,000 having at least one basic nitrogen atom and from about 10 to about 100 oxyalkylene groups wherein said hydrocarbyl group contains from 1 to about 30 carbon atoms, said oxyalkylene groups contain from about 2 to about 5 carbon atoms and wherein the weight ratio of said polyamine to said hydrocarbyl poly(oxyalkylene)aminocarbamate ranges from about 3:1 to about 1:2.

2. The composition of claim 1 wherein the aliphatic alkylene polyamine has a number average molecular weight in the range of from about 600 to about 5000, the alkyl group of the Mannich polyamine has a number average molecular weight in the range of from about 600 to about 3,000, and the aminocarbamate has a number average molecular weight in the range of from about 600 to about 5000.

3. The composition of claim 2 wherein the aliphatic alkylene polyamine has a number average molecular weight in the range of from about 600 to about 1500, the alkyl group of the Mannich polyamine has a number average molecular weight in the range of from about 1000 to about 1100, and the aminocarbamate has a number average molecular weight in the range of from about 600 to about 2000.

4. The composition of claim 1 wherein weight of the mixture of polyamine and aminocarbamate ranges from about 100 ppmw to about 400 ppmw based on the fuel composition.

5. The composition of claim 4 wherein the weight of the mixture of polyamine and aminocarbamate ranges from about 200 ppmw to about 300 ppmw based on the fuel composition.

6. The composition of claim 4 wherein the weight ratio of polyamine to aminocarbamate ranges from about 2:1 to about 2:3.

7. The composition of claim 4 wherein the weight ratio of polyamine to aminocarbamate is about 1:1.

8. The fuel composition of claim 4 wherein the oil soluble polyamine is an aliphatic alkylene polyamine.

9. The fuel composition of claim 4 wherein the oil soluble polyamine is a Mannich polyamine.

10. The composition of claim 5 wherein the weight ratio of polyamine to aminocarbamate ranges from about 2:1 to about 2:3.

11. The composition of claim 5 wherein the weight ratio of polyamine to aminocarbamate is about 1:1.

12. A method for operating an electronic port fuel injected engine on an unleaded fuel composition compatible with carburetor and throttle body injected engines which comprises introducing into an electronic port fuel injected engine with the combustion intake charge an amount of from about 50 ppmw to about 500 ppmw to reduce intake valve deposits of a mixture of (a) an oil soluble polyamine selected from the group consisting of (i) an aliphatic alkylene polyamine containing at least one olefinic polymer chain attached to a nitrogen and/or carbon atom of the alkylene radical(s) connecting the amino nitrogen atoms, said alkylene group having from 1 to 8 carbon atoms, and said polyamine having a number average molecular weight in the range of from about 600 to about 10,000, (ii) a Mannich polyamine comprising the condensation product of a high molecular weight sulfur-free alkyl-substituted hydroxyaromatic compound wherein the alkyl group has a number average molecular weight from about 600 to about 10,000, an amine which contains an amino group having at least one active hydrogen atom, and an aldehyde, wherein the respective molar ratio of reactants is 1:0.1–10:0.1–10, or (iii) mixtures of (i) and (ii) and (b) an oil soluble hydrocarbyl poly(oxyalkylene)aminocarbamate having a number average molecular weight in the range of from about 600 to about 10,000 having at least one basic nitrogen atom and from about 10 to about 100 oxyalkylene groups wherein said hydrocarbyl group contains from 1 to about 30 carbon atoms, said oxyalkylene groups contain from about 2 to about 5 carbon atoms and wherein the weight ratio of said polyamine to said hydrocarbyl poly(oxyalkylene)aminocarbamate ranges from about 3:1 to about 1:2.

13. The method of claim 11 wherein the aliphatic alkylene polyamine has a number average molecular weight in the range of from about 600 to about 5000, the alkyl group of the Mannich polyamine has a number average molecular weight in the range of from about 600 to about 3,000, and the aminocarbamate has a number average molecular weight in the range of from about 600 to about 5000.

14. The method of claim 13 wherein the aliphatic alkylene polyamine has a number average molecular weight in the range of from about 600 to about 1500, the alkyl group of the Mannich polyamine has a number average molecular weight in the range of from about 1000 to about 1100, and the aminocarbamate has a number average molecular weight in the range of from about 600 to about 2000.

15. The method of claim 12 wherein the weight of time mixture of polyamine and aminocarbamate ranges from about 100 ppmw to about 400 ppmw based on the fuel composition, 16. The method of claim 15 wherein the weight of the mixture of polyamine and aminocarbamate ranges from about 200 ppmw to about 300 ppmw based on the fuel composition.

17. The method of claim 15 wherein the weight ratio of polyamine to aminocarbamate ranges from about 2:1 to about 2:3.

18. The method of claim 15 wherein the weight ratio of polyamine to aminocarbamate is about 1:1.

19. The method of claim 15 wherein the oil soluble polyamine is an aliphatic alkylene polyamine.

20. The method of claim 15 wherein the oil soluble polyamine is a Mannich polyamine.

21. The method of claim 16 wherein the weight ratio of polyamine to aminocarbamate ranges from about 2:1 to about 2:3.

22. The method of claim 16 wherein the weight ratio of polyamine to aminocarbamate is about 1:1.

23. An unleaded fuel composition comprising a major amount of a hydrocarbon base fuel of the gasoline boiling range containing an effective amount to reduce intake valve deposits in electronic port fuel injected engines of about 250 ppmw based on the fuel composition of a mixture of (a) an oil soluble polyamine selected from the group consisting of (i) an aliphatic alkylene polyamine containing at least one olefinic polymer chain attached to a nitrogen and/or carbon atom of the alkylene radical(s) connecting the amino nitrogen atoms, said alkylene group having from 1 to 8 carbon atoms, and said polyamine having a number average molecular weight in the range of from about 600 to about 10,000, (ii) a Mannich polyamine comprising the condensation product of a high molecular weight sulfur-free alkyl-substituted hydroxyaromatic compound wherein the alkyl group has a number average molecular weight from about 600 to about 10,000, an amine which contains an amino group having at least one active hydrogen atom, and an aldehyde, wherein the respective molar ratio of reactants is 1:0.1–10:0.1–10, or (iii) mixtures of (i) and (ii) and (b) an oil soluble hydrocarbyl poly(oxyalkylene)aminocarbamate having a number average molecular weight in the range of from about 600 to about 10,000 having at least one basic nitrogen atom and from about 10 to about 100 oxyalkylene groups wherein said hydrocarbyl group contains from 1 to about 30 carbons atoms, said oxyalkylene groups contain from about 2 to about 5 carbon atoms and wherein the weight ratio of said polyamine to said hydrocarbyl poly-(oxyalkylene)aminocarbamate is about 1:1.

24. A method for operating an electronic port fuel injected engine on an unleaded fuel composition compatible with carburetor and throttle body injected engines which comprises introducing into an electronic port fuel injected engine with the combustion intake charge an amount of about 250 ppmw to reduce intake valve deposits of a mixture of (a) an oil soluble polyamine selected from the group consisting of (i) an aliphatic alkylene polyamine containing at least one olefinic polymer chain attached to a nitrogen and/or carbon atom of the alkylene radical(s) connecting the amino nitrogen atoms, said alkylene group having from 1 to 8 carbon atoms, and said polyamine having a number average molecular weight in the range of from about 600 to about 10,000, (ii) a Mannich polyamine comprising the condensation product of a high molecular weight sulfur-free alkyl-substituted hydroxyaromatic compound wherein the alkyl group has a number average molecular weight from about 600 to about 10,000, an amine which contains an amino group having at least one active hydrogen atom, and an aldehyde, wherein the respective molar ratio of reactants is 1:0.1–10:0.1–10, or (iii) mixtures of (i) and (ii) and (b) an oil soluble hydrocarbyl poly(oxyalkylene)aminocarbamate having a number average molecular weight in the range of from about 600 to about 10,000 having at least one basic nitrogen atom and from about 10 to about 100 oxyalkylene groups wherein said hydrocarbyl group contains from 1 to about 30 carbons atoms, said oxyalkylene groups contain from about 2 to about 5 carbon atoms and wherein the weight ratio of said polyamine to said hydrocarbyl poly-(oxyalkylene)aminocarbamate is about 1:1.

25. An unleaded fuel composition comprising a major amount of a hydrocarbon base fuel of the gasoline boiling range containing an effective amount to reduce intake valve deposits in electronic port fuel injected engines of from about 100 ppmw to about 400 ppmw based on the fuel composition of a mixture of (a) an oil soluble aliphatic alkylene polyamine containing at least one olefinic polymer chain attached to a nitrogen and/or carbon atom of the alkylene radical(s) connecting the amino nitrogen atoms, said alkylene group having from one to four carbon atoms, and said polyamine having a number average molecular weight in the range of from about 600 to about 1,500 and (b) an oil soluble hydrocarbyl poly(oxyalkylene)aminocarbamate having a number average molecular weight in the range of from about 600 to about 2,000 having at least one basic nitrogen atom and from about 10 to about 25 oxyalkylene groups wherein said hydrocarbyl group contains from 1 to about 30 carbons atoms, said oxyalkylene groups contain from about 2 to about 5 carbon atoms and wherein the weight ratio of said aliphatic alkylene polyamine to said hydrocarbyl poly(oxyalkylene)aminocarbamate ranges from about 3:1 to about 1:2.

26. The composition of claim 25 wherein the weight of the mixture of polyamine and aminocarbamate ranges from about 200 ppmw to about 300 ppmw based on the fuel composition.

27. The composition of claim 26 wherein the aliphatic alkylene polyamine has a number average molecular weight of about 1050 and the hydrocarbyl poly(oxyalkylene)aminocarbamate has a number average molecular weight of from about 1400 to about 1800.

28. The composition of claim 26 wherein the weigh ratio of said aliphatic alkylene polyamine to said hydrocarbyl poly(oxyalkylene)aminocarbamate is about 1:1.

29. The composition of claim 28 wherein the aminocarbamate is alkylphenyl-poly(oxyalkylene)-N-(2-aminoethyl-)carbamate.

30. A method for operating an electronic port fuel injected engine on an unleaded fuel composition compatible with carburetor and throttle body injected engines which comprises introducing into an electronic port fuel injected engine with the combustion intake charge an effective amount of from about 100 ppmw to about 400 ppmw to reduce intake valve deposits of a mixture of (a) an oil soluble aliphatic alkylene polyamine selected from the group consisting of (i) an aliphatic alkylene polyamine containing at least one olefinic polymer chain attached to a nitrogen and/or carbon atom of the alkylene radical(s) connecting the amino nitrogen atoms, said alkylene group having from one to four carbon atoms, and said polyamine having a number average molecular weight in the range of from about 600 to about 1,500 and (b) an oil soluble hydrocarbyl poly(oxyalkylene-)aminocarbamate having a number average molecular weight in the range of from about 600 to about 2,000 having at least one basic nitrogen atom and from about 10 to about 25 oxyalkylene groups wherein said hydrocarbyl group contains from 1 to about 30 carbons atoms, said oxyalkylene groups contain from about 2 to about 5 carbon atoms and wherein the weight ratio of said aliphatic alkylene polyamine to said hydrocarbyl poly(oxyalkylene)aminocarbamate ranges from about 3:1 to about 1:2.

31. The method of claim 30 wherein the weight of the mixture of polyamine and aminocarbamate ranges from about 200 ppmw to about 300 ppmw based on the fuel composition.

32. The method of claim 31 wherein the aliphatic alkylene polyamine has a number average molecular weight of about 1050 and the hydrocarbyl poly(oxyalkylene)aminocarbamate has a number average molecular weight of about 1400 to about 1800.

33. The method of claim 32 wherein the weight ratio of said aliphatic alkylene polyamine to said hydrocarbyl poly-(oxyalkylene)aminocarbamate is about 1:1.

34. The method of claim 31 wherein the aminocarbamate is alkylphenyl-poly(oxyalkylene)-N-(2-aminoethyl)carbamate.

35. An unleaded fuel composition comprising a major amount of a hydrocarbon base fuel of the gasoline boiling range containing an effective amount to reduce intake valve deposits in electronic port fuel injected engines of from about 200 ppmw to about 300 ppmw based on the fuel composition of a mixture of (a) a N-polyisobutenyl-N',N'-dimethyl-1,3-diaminopropane having a number average molecular weight in the range of from about 600 to about 1500 and (b) an alkylphenyl-poly(oxyalkylene)-N-(2-aminoethyl)carbamate having a number average molecular weight in the range of from about 1400 to about 1800 having at least one basic nitrogen atom and from about 10 to about 25 oxyalkylene groups wherein said alkylphenyl group contains from 1 to about 30 carbons atoms, said oxyalkylene groups contain from about 2 to about 5 carbon atoms and wherein the weight ratio of said N-polyisobutenyl-N',N'-dimethyl-1,3-diaminopropane to said alkylphenyl-poly(oxyalkylene)-N-(2-aminoethyl)carbamate ranges from about 3:1 to about 1:2.

36. A method for operating an electronic port fuel injected engine on an unleaded fuel composition compatible with carburetor and throttle body injected engines which comprises introducing into an electronic port fuel injected engine with the combustion intake charge an effective amount of from about 200 ppmw to about 300 ppmw to reduce intake valve deposits of a mixture of (a) a N-polyisobutenyl-N',N'-dimethyl-1,3-diaminopropane having a number average molecular weight in the range of from about 600 to about 1500 and (b) an alkylphenyl-poly(oxyalkylene)-N-(2-aminoethyl)carbamate having a number average molecular weight in the range of from about 1400 to about 1800 having at least one basic nitrogen atom and from about 10 to about 25 oxyalkylene groups wherein said alkylphenyl group contains from 1 to about 30 carbons atoms, said oxyalkylene groups contain from about 2 to about 5 carbon atoms and wherein the weight ratio of said N-polyisobutenyl-N',N'-dimethyl-1,3-diaminopropane to said alkylphenyl-poly(oxyalkylene)-N-(2aminoethyl)carbamate ranges from about 3:1 to about 1:2.

37. An unleaded fuel composition comprising a major amount of a hydrocarbon base fuel of the gasoline boiling range containing an effective amount to reduce intake valve deposits in electronic port fuel injected engines of about 200 ppmw based on the fuel composition of a mixture of (a) a N-polyisobutenyl-N',N'-dimethyl-1,3-diaminopropane having a number average molecular weight in the range of from about 600 to about 1500 and (b) an alkylphenyl-poly(oxyalkylene)-N-(2-aminoethyl)carbamate having a number average molecular weight in the range of from about 1400 to about 1800 having at least one basic nitrogen atom and from about 10 to about 25 oxyalkylene groups wherein said alkylphenyl group contains from 1 to about 30 carbons atoms, said oxyalkylene groups contain from about 2 to about 5 carbon atoms and wherein the weight ratio of said N-polyisobutenyl-N',N'-dimethyl-1,3-diaminopropane to said alkylphenyl-poly(oxyalkylene)-N-(2-aminoethyl)carbamate is about 3:1.

38. An unleaded fuel composition comprising a major amount of a hydrocarbon base fuel of the gasoline boiling range containing an effective amount to reduce intake valve deposits in electronic port fuel injected engines of about 200 ppmw based on the fuel composition of a mixture of (a) a N-polyisobutenyl-N',N'-dimethyl-1,3-diaminopropane having a number average molecular weight in the range of from about 600 to about 1500 and (b) an alkyl phenyl-poly(oxyalkylene)-N-(2-aminoethyl)carbamate having a number average molecular weight in the range of from about 1400 to about 1800 having at least one basic nitrogen atom and from about 10 to about 25 oxyalkylene groups wherein said alkylphenyl group contains from 1 to about 30 carbons atoms, said oxyalkylene groups contain from about 2 to about 5 carbon atoms and wherein the weight ratio of said N-polyisobutenyl-N',N'-dimethyl-1,3-diaminopropane to said alkylphenyl-poly(oxyalkylene)-N-(2-aminoethyl)carbamate is about 1:1.

39. An unleaded fuel composition comprising a major amount of a hydrocarbon base fuel of the gasoline boiling range containing an effective amount to reduce intake valve deposits in electronic port fuel injected engines of about 250 ppmw based on the fuel composition of a mixture of (a) a N-polyisobutenyl-N',N'-dimethyl-1,3-diaminopropane having a number average molecular weight in the range of from about 600 to about 1500 and (b) an alkylphenyl-poly(oxyalkylene)-N-(2-aminoethyl)carbamate having a number average molecular weight in the range of from about 1400 to about 1800 having at least one basic nitrogen atom and from about 10 to about 25 oxyalkylene groups wherein said alkylphenyl group contains from 1 to about 30 carbons atoms, said oxyalkylene groups contain from about 2 to about 5 carbon atoms and wherein the weight ratio of said N-polyisobutenyl-N',N'-dimethyl-1,3-diaminopropane to said alkylphenyl-poly(oxyalkylene)-N-(2-aminoethyl)carbamate is about 1:1.

40. A method for operating an electronic port fuel injected engine on an unleaded fuel composition compatible with carburetor and throttle body injected engines which comprises introducing into an electronic port fuel injected engine with the combustion intake charge about 200 ppmw based on the fuel composition to reduce intake valve deposits of a mixture of (a) a N-polyisobutenyl-N',N'-dimethyl-1,3-diaminopropane having a number average molecular weight in the range of from about 600 to about 1500 and (b) an alkylphenyl-poly(oxyalkylene)-N-(2-aminoethyl)carbamate having a number average molecular weight in the range of from about 1400 to about 1800 having at least one basic nitrogen atom and from about 10 to about 25 oxyalkylene groups wherein said alkylphenyl group contains from 1 to about 30 carbons atoms, said oxyalkylene groups contain from about 2 to about 5 carbon atoms and wherein the weight ratio of said N-polyisobutenyl-N',N'-dimethyl-1,3-diaminopropane to said alkylphenyl-poly(oxyalkylene)-N-(2-aminoethyl)carbamate is about 3:1.

41. A method for operating an electronic port fuel injected engine on an unleaded fuel composition compatible with carburetor and throttle body injected engines which comprises introducing into an electronic port fuel injected engine with the combustion intake charge about 200 ppmw based on the fuel composition to reduce intake valve deposits of a mixture of (a) a N-polyisobutenyl-N',N'-dimethyl-1,3-diaminopropane having a number average molecular weight in the range of from about 600 to about 1500 and (b) an alkylphenyl-poly(oxyalkylene)-N-(2-aminoethyl)carbamate having a number average molecular weight in the range of from about 1400 to about 1800 having at least one basic nitrogen atom and from about 10 to about 25 oxyalkylene groups wherein said alkylphenyl group contains from 1 to about 30 carbons atoms, said oxyalkylene groups contain from about 2 to about 5 carbon atoms and wherein the weight ratio of said N-polyisobutenyl-N',N'-dimethyl-1,3-diaminopropane to said alkylphenyl-poly(oxyalkylene)-N-(2-aminoethyl)carbamate is about 1:1.

42. A method for operating an electronic port fuel injected engine on an unleaded fuel composition compatible with carburetor and throttle body injected engines which comprises introducing into an electronic port fuel injected engine with the combustion intake charge about 250 ppmw based on the fuel composition to reduce intake valve deposits of a mixture of (a) a N-polyisobutenyl-N',N'-dimethyl-1,3-diaminopropane having a number average molecular weight in the range of from about 600 to about 1500 and (b) an alkylphenyl-poly(oxyalkylene)-N-(2-aminoethyl)carbamate having a number average molecular weight in the range of from about 1400 to about 1800 having at least one basic nitrogen atom and from about 10 to about 25 oxyalkylene groups wherein said alkylphenyl group contains from 1 to about 30 carbons atoms, said oxyalkylene groups contain from about 2 to about 5 carbon atoms and wherein the weight ratio of said N-polyisobutenyl-N',N'-dimethyl-1,3-diaminopropane to said alkylphenyl-poly(oxyalkylene)-N-(2-aminoethyl)carbamate is about 1:1.

43. An unleaded fuel composition comprising a major amount of a hydrocarbon base fuel of the gasoline boiling range containing an effective amount to reduce intake valve deposits in electronic port fuel injected engines of from about 50 ppmw to about 500 ppmw based on the fuel composition of a mixture of (a) a Mannich polyamine comprising the condensation product of a high molecular weight sulfur-free alkyl-substituted hydroxyaromatic compound wherein the alkyl group has a number average molecular weight from about 750 to about 1200, an amine which contains an amino group having at least one active hydrogen atom, and an aldehyde, wherein the respective molar ratio of reactants is 1:0.1–10:0.1–10 and (b) an alkylphenyl-poly(oxyalkylene)-N-(2-aminoethyl)carbamate having a number average molecular weight in the range of from about 1400 to about 1800 having at least one basic nitrogen atom and from about 10 to about 25 oxyalkylene groups wherein said hydrocarbyl group contains from 1 to 30 carbon atoms, and said oxyalkylene groups contain from about 2 to about 5 carbon atoms and wherein the weight ratio of said Mannich polyamine to said alkylphenyl-poly(oxyalkylene)-N-(2-aminoethyl)carbamate is about 1:1.

44. The fuel composition of claim 43 wherein the weight of the mixture of polyamine and aminocarbamate is about 250 ppmw.

45. A method for operating an electronic port fuel injected engine on an unleaded fuel composition compatible with carburetor and throttle body injected engines which comprises introducing into an electronic port fuel injected engine with the combustion intake charge an amount from about 50 ppmw to about 500 ppmw to reduce intake valve deposits of a mixture of (a) a Mannich polyamine comprising the condensation product of a high molecular weight sulfur-free alkyl-substituted hydroxyaromatic compound wherein the alkyl group has a number average molecular weight from about 750 to about 1200, an amine which contains an amino group having at least one active hydrogen atom, and an aldehyde, wherein the respective molar ratio of reactants is 1: 0.1–10:0.1–10and (b) an alkylphenyl-poly(oxyalkylene)-N-(2-aminoethyl)carbamate having a number average molecular weight in the range of from about 1400 to about 1800 having at least one basic nitrogen atom and from about 10 to about 25 oxyalkylene groups wherein said hydrocarbyl group contains from 1 to 30 carbon atoms, and said oxyalkylene groups contain from about 2 to about 5 carbon atoms and wherein the weight ratio of said Mannich polyamine to said alkylphenyl-poly(oxyalkylene)-N-(2-aminoethyl)carbamate is about 1:1.

46. The method of claim 45 wherein the weight of the mixture of polyamine and aminocarbamate is about 250 ppmw.

* * * * *